US009030400B2

(12) United States Patent
Lee et al.

(10) Patent No.: US 9,030,400 B2
(45) Date of Patent: May 12, 2015

(54) TEMPERATURE DEPENDENCE OF CHARGE SHARING FOR A LIQUID CRYSTAL DISPLAY

(75) Inventors: Whee-Won Lee, Busan (KR); Jae Hoon Lee, Seoul (KR); Young-Su Kim, Daegu (KR)

(73) Assignee: Samsung Display Co., Ltd., Yongin (KR)

( * ) Notice: Subject to any disclaimer, the term of this patent is extended or adjusted under 35 U.S.C. 154(b) by 159 days.

(21) Appl. No.: 13/460,566

(22) Filed: Apr. 30, 2012

(65) Prior Publication Data

US 2013/0135273 A1 May 30, 2013

(30) Foreign Application Priority Data

Nov. 24, 2011 (KR) ..... 10-2011-0123575

(51) Int. Cl.
*G09G 3/36* (2006.01)

(52) U.S. Cl.
CPC ..... *G09G 3/3688* (2013.01); *G09G 3/3614* (2013.01); *G09G 2300/0426* (2013.01); *G09G 2320/041* (2013.01)

(58) Field of Classification Search
CPC ..... G09G 3/3614; G09G 3/3688; G09G 2310/027; G09G 2320/041; G09G 2300/0426; G09G 2320/0242
USPC ..... 345/212, 512, 87, 96, 100, 85, 89, 101
See application file for complete search history.

(56) References Cited

U.S. PATENT DOCUMENTS

| | | | | |
|---|---|---|---|---|
| 6,269,026 | B1 | 7/2001 | Venkatesh et al. | |
| 7,403,185 | B2 * | 7/2008 | Song et al. | 345/100 |
| 7,570,243 | B2 | 8/2009 | Kang et al. | |
| 7,948,465 | B2 * | 5/2011 | Cho et al. | 345/99 |
| 8,253,078 | B2 * | 8/2012 | Hsieh | 219/494 |
| 8,368,629 | B2 * | 2/2013 | Jung et al. | 345/89 |
| 2008/0054987 | A1 * | 3/2008 | Choi et al. | 327/512 |
| 2009/0002291 | A1 | 1/2009 | Koo et al. | |
| 2009/0002302 | A1 * | 1/2009 | Koo et al. | 345/89 |
| 2009/0109201 | A1 | 4/2009 | Kim et al. | |
| 2010/0231577 | A1 * | 9/2010 | Kim et al. | 345/212 |
| 2012/0098813 | A1 * | 4/2012 | Park et al. | 345/211 |
| 2012/0182489 | A1 * | 7/2012 | Wang et al. | 349/38 |

FOREIGN PATENT DOCUMENTS

| | | |
|---|---|---|
| JP | 2005-308546 | 11/2005 |
| KR | 1020080049329 | 6/2008 |
| KR | 1020080053608 | 6/2008 |
| KR | 1020110063242 | 6/2011 |
| KR | 1020110066777 | 6/2011 |
| KR | 1020110067355 | 6/2011 |

* cited by examiner

*Primary Examiner* — Chanh Nguyen
*Assistant Examiner* — Yuzhen Shen
(74) *Attorney, Agent, or Firm* — H.C. Park & Associates, PLC

(57) ABSTRACT

A liquid crystal display, including: pixels; a signal controller receiving an input image signal and an input control signal and outputting a processing image signal and a control signal; and a data driver changing the processing image signal to data voltage on the basis of the control signal to supply the data voltage to the pixel and sharing charges of odd channel data voltage of an odd channel and even channel data voltage of an even channel which have different polarities on the basis of a temperature.

13 Claims, 17 Drawing Sheets

TEMPERATURE DEPENDENCE OF CHARGE SHARING FOR A LIQUID CRYSTAL DISPLAY

CROSS-REFERENCE TO RELATED APPLICATION

This application claims priority to and the benefit of Korean Patent Application No. 10-2011-0123575, filed on Nov. 24, 2011, which is hereby incorporated by reference for all purposes as if fully set forth herein.

BACKGROUND

1. Field

Exemplary embodiments of the present invention relate to a liquid crystal display.

2. Discussion of the Background

A liquid crystal display, which is one of the most common types of flat panel displays currently in use, includes two panels with field generating electrodes, such as a pixel electrode, a common electrode, and the like, and a liquid crystal layer interposed therebetween. The liquid crystal display generates an electric field in the liquid crystal layer by applying voltage to the field generating electrodes, and determines the orientation direction of liquid crystal molecules of the liquid crystal layer by the generated electric field, thus controlling polarization of incident light so as to display images.

The liquid crystal display may include a thin film transistor that switches application of data voltage and, in the thin film transistor, a current characteristic may be reduced at a low temperature and the data voltage may not be sufficiently charged in the pixel. Further, in the case of a precharge driving mode for compensating a charging time, when an image signal of a mixed color pattern is inputted, a bar line may be shown, thereby deteriorating display quality.

The above information disclosed in this Background section is only for enhancement of understanding of the background of the invention and therefore it may contain information that does not form the prior art that is already known in this country to a person of ordinary skill in the art.

SUMMARY OF THE INVENTION

An exemplary embodiment of the present invention provides a liquid crystal display including a thin film transistor having an improved current characteristic so that the data voltage may be sufficiently charged in the pixels at low temperature.

Additional features of the invention will be set forth in the description which follows, and in part will be apparent from the description, or may be learned by practice of the invention.

An exemplary embodiment of the present invention discloses a liquid crystal display, including: pixels; a signal controller receiving an input image signal and an input control signal and outputting a processing image signal and a control signal; and a data driver changing the processing image signal to data voltage on the basis of the control signal to supply the data voltage to the pixel. The data driver causes charges of odd channel data voltage of an odd channel and even channel data voltage of an even channel which have different polarities to be shared based on temperature.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention

DETAILED DESCRIPTION OF THE ILLUSTRATED EMBODIMENT

Figure 1:
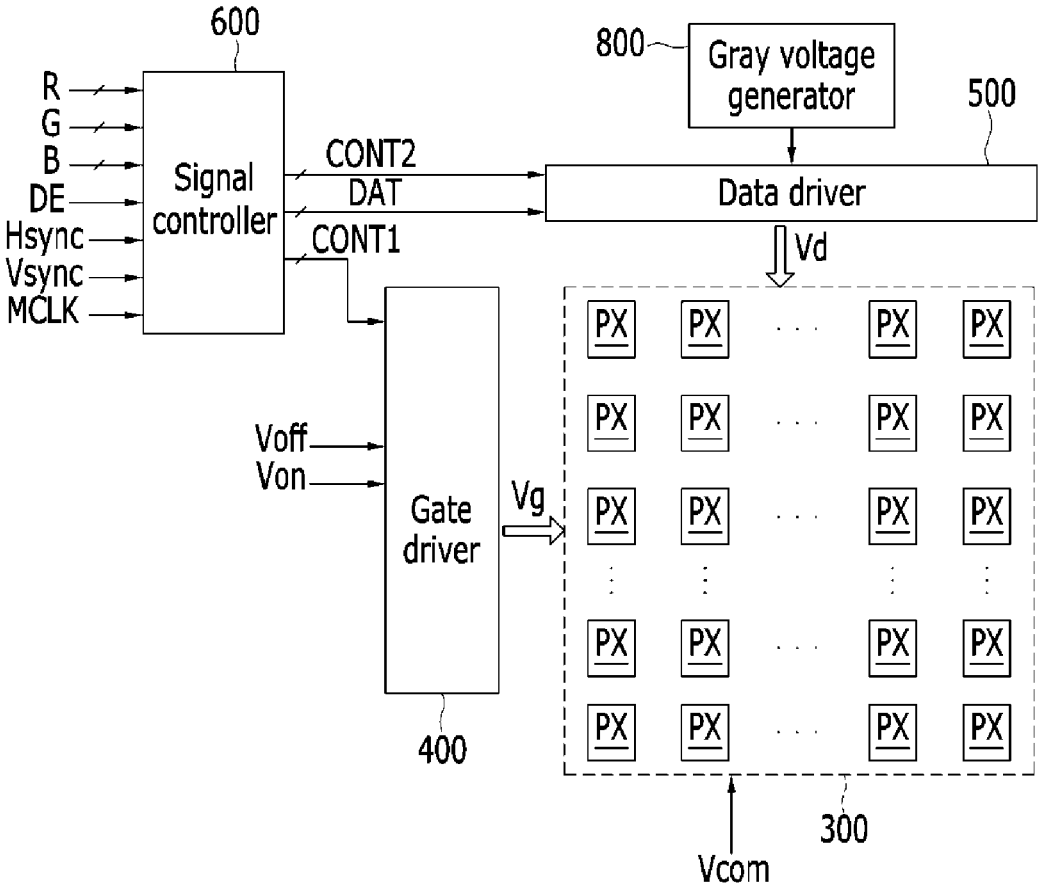
FIG. 1 is a schematic diagram illustrating a liquid crystal display according to an exemplary embodiment of the present invention.

The present invention will be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the thicknesses of layers, films, panels, regions, etc., are exaggerated for clarity. Like reference numerals in the drawings denote like elements.

It will be understood that when an element such as a layer, film, region, or substrate is referred to as being "on" or "connected to" another element, it can be directly on or connected to the other element, or intervening elements may also be present. In contrast, when an element is referred to as being "directly on" or "directly connected to" another element, there are no intervening elements present. It will be understood that for the purposes of this disclosure, "at least one of X, Y, and Z" can be construed as X only, Y only, Z only, or any combination of two or more items X, Y, and Z (e.g., XYZ, XYY, YZ, ZZ).

FIG. 1 is a schematic diagram illustrating a liquid crystal display according to an exemplary embodiment of the present invention.

Referring to FIG. 1, a liquid crystal panel assembly 300 includes a plurality of pixels PX arranged in a substantially matrix form. The plurality of pixels PX is connected to a plurality of signal lines. The signal lines include a plurality of gate lines for transferring gate signals (also, referred to as "scanning lines") and a plurality of data lines for transferring data signals.

A gray voltage generator 800 generates two gray voltage sets (or reference gray voltage sets) relating to transmittance of the pixel. One set of the two gray voltage sets has a positive value for a common voltage Vcom, and the other set has a negative value.

A gate driver 400 is connected to the gate line of the liquid crystal panel assembly 300 to apply a gate signal configured by combining gate-on voltage Von and gate-off voltage Voff to the gate line.

A data driver 500 is connected to the data line of the liquid crystal panel assembly 300 to select the gray voltage from the gray voltage generator 800 and apply the selected gray voltage to the pixel as data voltage. The gray voltage generator 800 need not supply all voltages for all gray levels. Rather, the gray voltage generator 800 may supply a predetermined number of the reference gray voltages, the data driver 500 divides the reference gray voltages to generate gray voltages for the entire gray scale and select a data signal among the gray voltages.

A signal controller 600 controls the gate driver 400 and the data driver 500.

Each of the drivers 400, 500, 600, and 800 may be directly mounted on the liquid crystal panel assembly 300 in at least one IC chip form or mounted on a flexible printed circuit film (not shown) to be attached to the liquid crystal panel assembly 300 in a tape carrier package (TCP) form. On the contrary, the drivers 400, 500, 600, and 800 may be integrated to the liquid crystal panel assembly 300 together with the signal lines and a thin film transistor switching element. Further, all the drivers 400, 500, 600, and 800 may be integrated in a single chip and in this case, at least one of the drivers 400, 500, 600, and 800 or at least one circuit element configuring the drivers 400, 500, 600, and 800 may be disposed outside the single chip.

The signal controller 600 receives input image signals R, G, and B and an input control signal controlling a display thereof from an external graphic controller (not shown). The input image signals R, G, and B have luminance information of each pixel PX and the luminance has a predetermined number, for example, 1024 ($=2^{10}$), 256 ($=2^{8}$), or 64 ($=2^{6}$) gray levels. Examples of the input control signal include a vertical synchronization signal Vsync, a horizontal synchronizing signal Hsync, a main clock MCLK, a data enable signal DE, and the like.

The signal controller 600 properly processes the input image signals R, G, and B to be suitable for operating the liquid crystal panel assembly 300 and the data driver 500 based on the input image signals R, G, and B and the input control signal. After the signal controller 600 generates a gate control signal CONT1, a data control signal CONT2, a backlight control signal CONT3, and the like, the signal controller 600 transmits the gate control signal CONT1 to the gate driver 400 and outputs the data control signal CONT2 and the processed image signal DAT to the data driver 500. The output image signal DAT has the predetermined number of values (or gray levels) as a digital signal.

The gate control signal CONT1 includes a scanning start signal STV instructing a scanning start and at least one clock signal controlling an output period of the gate-on voltage Von. The gate control signal CONT1 may further include an output enable signal OE limiting a duration time of the gate-on voltage Von.

The data control signal CONT2 includes a horizontal synchronization start signal notifying a transmission start of the image data for the pixels PX of one row and a load signal instructing the application of the data signal to data lines, and a data clock signal. The data control signal CONT2 may further include an inversion signal inverting a voltage polarity of the data signal with respect to the common voltage Vcom (hereinafter, referred to as a "polarity of the data signal" by shortening "the voltage polarity of the data signal with respect to the common voltage").

According to the data control signal CONT2 from the signal controller 600, the data driver 500 receives the digital image signal DAT for the pixels PX of one row and selects the gray voltage corresponding to each digital image signal DAT and as a result, converts the digital image signal DAT into an analog data signal and then applies the analog data signal to the corresponding data lines. The number of the gray voltages generated by the gray voltage generator 800 may be the same as the number of the gray levels represented by the digital image signal DAT.

The gate driver 400 applies the gate-on voltage Von to the gate lines according to the gate control signal CONT1 from the signal controller 600 to turn on the switching element connected to the gate lines. Then, the data signal applied to the data lines is applied to the corresponding pixel PX through the turned-on switching element.

A difference between the voltage of the data signal applied to the pixel PX and the common voltage Vcom is represented as charged voltage of the liquid crystal capacitor, in other words, "pixel voltage". Liquid crystal molecules are arranged differently according to a size of the pixel voltage and accordingly, polarization of light passing through a liquid crystal layer 3 is changed. The change of the polarization is represented as a change in transmittance of light by a polarizer attached to the display panel assembly 300, such that the pixel PX displays luminance represented by the gray of the image signal DAT.

By repeating the process as a unit of 1 horizontal period (also written as "1H" and the same as one period of the horizontal synchronizing signal Hsync and the data enable signal DE), the gate-on voltage Von is sequentially applied to the plurality of gate lines to apply the data signal to the plurality of pixels PX, thereby displaying images of one frame.

One frame ends, the next frame starts, and a state of the inversion signal applied to the data driver 500 is controlled so that a polarity of the data signal applied to each pixel PX is opposite to a polarity of the previous frame ("frame inversion"). In this case, the polarity of the data signal flowing through one data line may be changed according to a characteristic of the inversion signal even in one frame (for example, row inversion and dot inversion) or the polarities of the data signals applied to one pixel row may also be different from each other (for example, column inversion and dot inversion).

Figure 2:
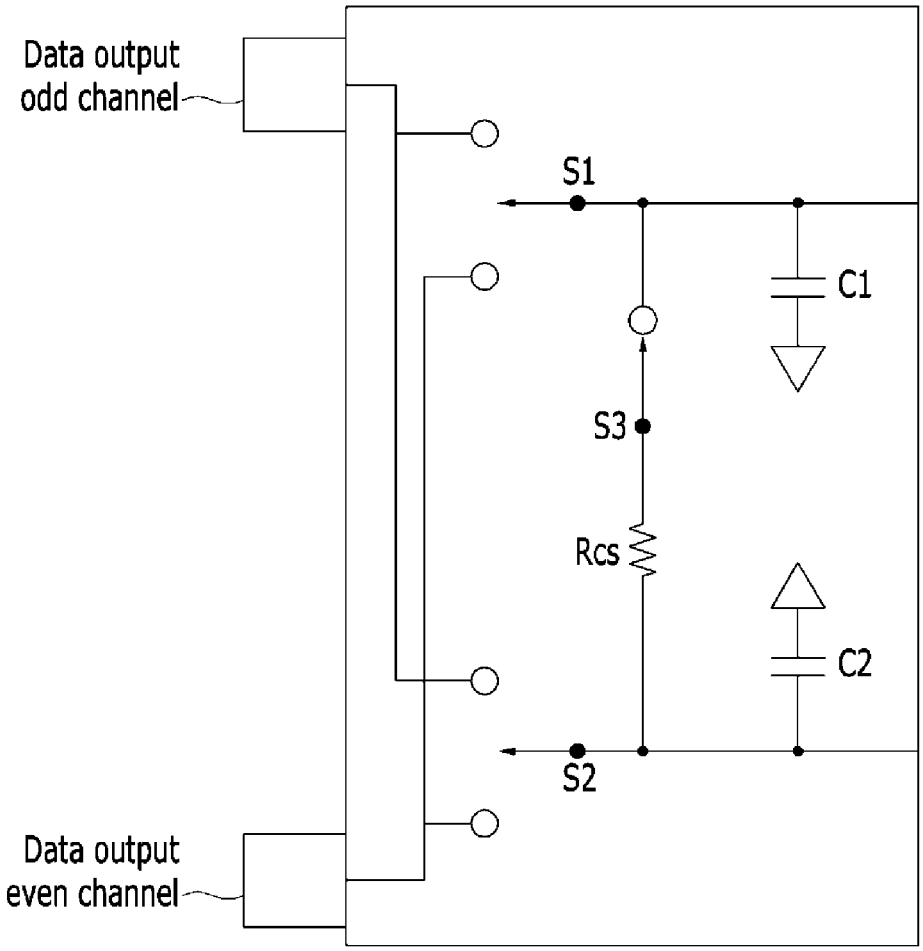
FIG. 2 is a schematic diagram illustrating a charge share circuit of a liquid crystal display according to an exemplary embodiment of the present invention.
Figure 3:
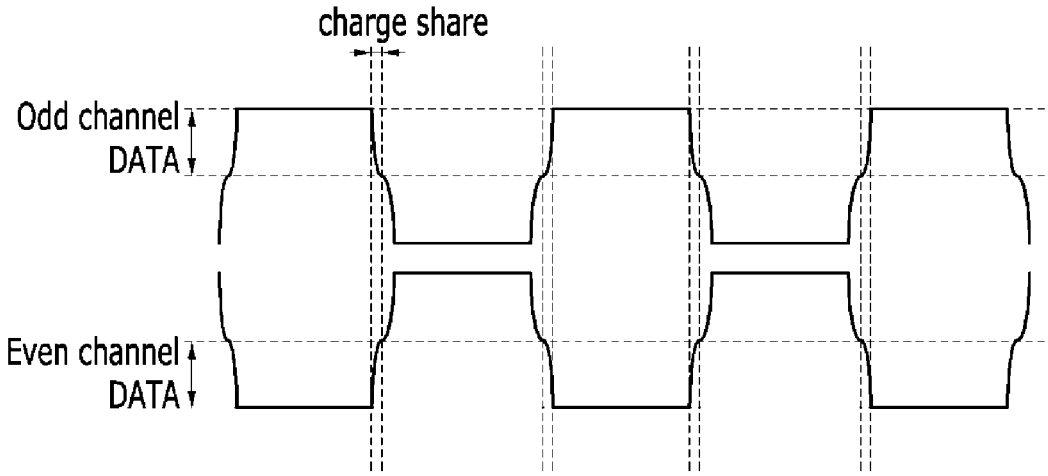
FIG. 3 is a signal waveform diagram of a charge share circuit according to an exemplary embodiment of the present invention.

FIG. 2 is a schematic diagram illustrating a charge share circuit of a liquid crystal display according to an exemplary embodiment of the present invention, and FIG. 3 is a signal waveform diagram of a charge share circuit according to an exemplary embodiment of the present invention.

Referring to FIGS. 2 and 3, the data driver 500 shares charges of data voltage of an odd channel and data voltage of an even channel which have different polarities. For example, the charge sharing may be applied in a polarity transition section. When the liquid crystal display performs the charge sharing operation, power consumption may be reduced, electromagnetic radiation may be reduced, and a slew rate may increase. Hereinafter, the charge sharing operation will be described. First, a first switch S1 is connected to the odd channel and a second switch S2 is connected to the even channel to charge the charges in a first capacitor C1 and a second capacitor C2, respectively, and in this case, a third switch S3 is turned off. Next, the charging of the data voltage ends and the polarity transition section starts and in this case, the first switch S1 and the second switch S2 are turned off and the third switch S3 is turned on, such that the charges are shared between the first capacitor Cl and the second capacitor C2. Next, the third switch S3 is turned off, the first switch S1 is connected to the even channel, and the second switch S2 is connected to the odd channel to charge the first capacitor Cl and the second capacitor C2, respectively and then, the described operations are repeated.

Figure 4:
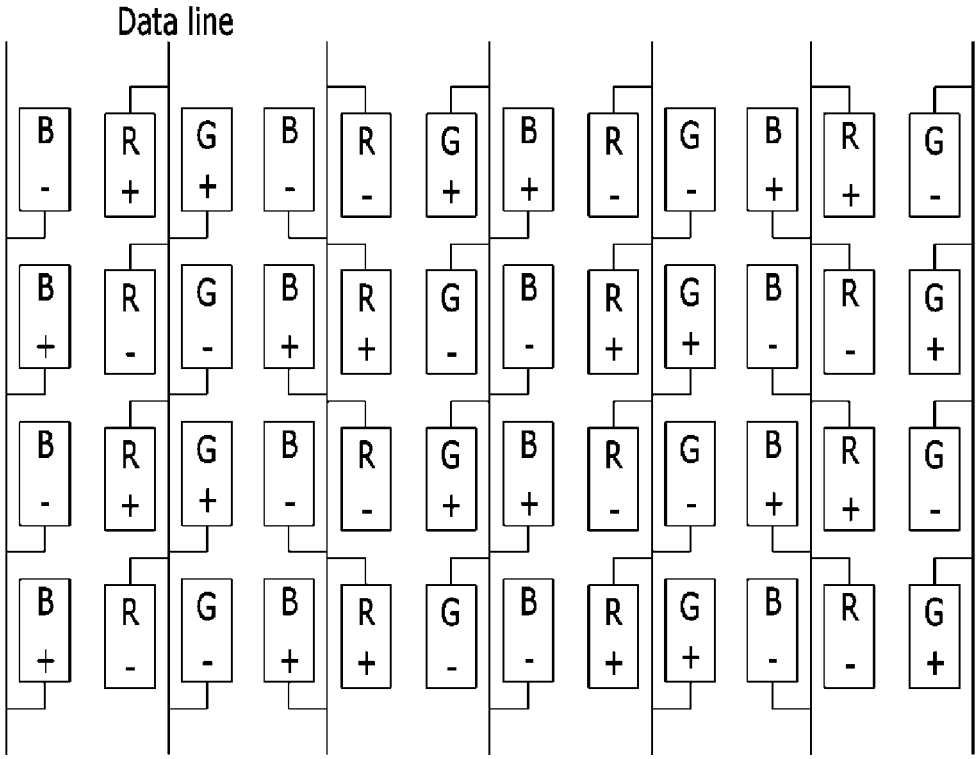
FIG. 4 is a diagram illustrating an inversion drive of a liquid crystal display according to an exemplary embodiment of the present invention.
Figure 5:
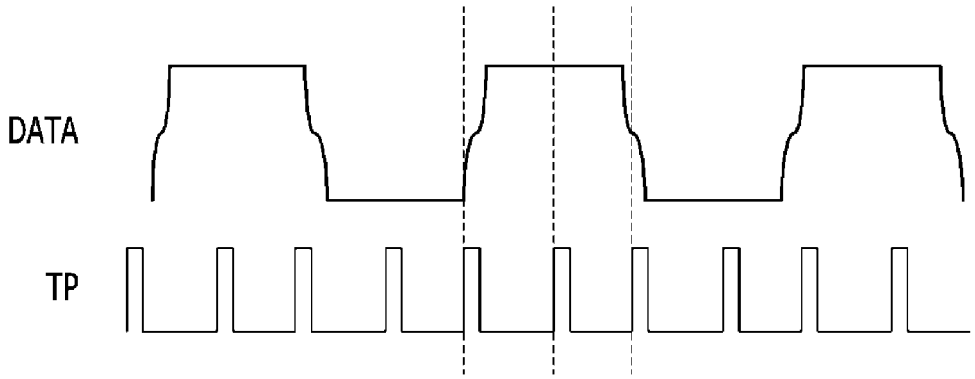
FIG. 5 is a signal waveform diagram of a liquid crystal display at room temperature according to an exemplary embodiment of the present invention.
Figure 6:
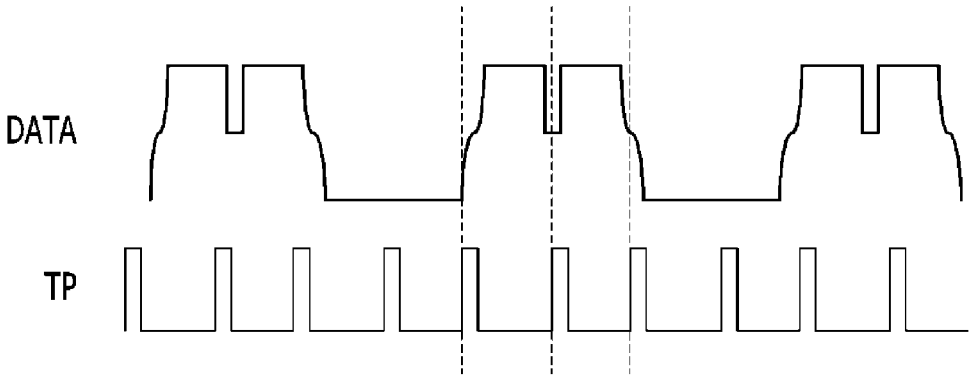
FIG. 6 is a signal waveform diagram of a liquid crystal display at a low temperature according to an exemplary embodiment of the present invention.

FIG. 4 is a diagram illustrating an inversion drive of a liquid crystal display according to an exemplary embodiment of the present invention, FIG. 5 is a signal waveform diagram of a liquid crystal display at room temperature according to an exemplary embodiment of the present invention, and FIG. 6 is a signal waveform diagram of a liquid crystal display at a low temperature according to an exemplary embodiment of the present invention.

Referring to FIG. 4, in the liquid crystal display, horizontally adjacent pixels may be connected to the data line disposed between the horizontally adjacent pixels, thereby minimizing flicker using a pixel layout, as shown in FIG. 4. The liquid crystal display performing a two dot inversion drive may minimize power consumption and improve image quality. In FIG. 4, R is red, G is green, and B is blue.

A charge sharing technique may be selectively applied to the data driver 500 of the liquid crystal display according to temperature. For example, referring to FIGS. 5 and 6, a charge sharing technique shown in FIG. 5 may be applied to the liquid crystal display performing the two dot inversion drive at room temperature, and a charge sharing technique shown in FIG. 6 may be applied to the liquid crystal display performing the two dot inversion drive at a low temperature less than room temperature. In the charge sharing technique shown in FIG. 5, a data output performs the charge sharing only in the polarity inversion at room temperature, such that the power consumption may be reduced and a contrast ratio may be improved. Further, in the charge sharing technique shown in FIG. 6, the data output performs the charge sharing every 1 horizontal period (1 H) at a low temperature and a charged charge amount may be reduced in a section when the data voltage of the same polarity is maintained, such that charge imbalance between the pixels may be prevented and a purplish phenomenon may be prevented.

On the contrary, in the case where the two dot inversion drive shown in FIG. 4 and the charge sharing technique shown in FIG. 5 are applied at a low temperature less than room temperature, since the charge amount charged in the pixel in the polarity inversion section is less than the charge amount charged in the pixel in the section when the same polarity is maintained and a current characteristic of the thin film transistor is reduced, the charging imbalance between the pixels may occur and the purplish phenomenon may occur. In the case where the charge sharing technique shown in FIG. 6 is applied at room temperature, the data output performs the charge sharing every 1 horizontal period (1 H), such that power consumption may increase and the contrast ratio may be reduced.

Figure 7:
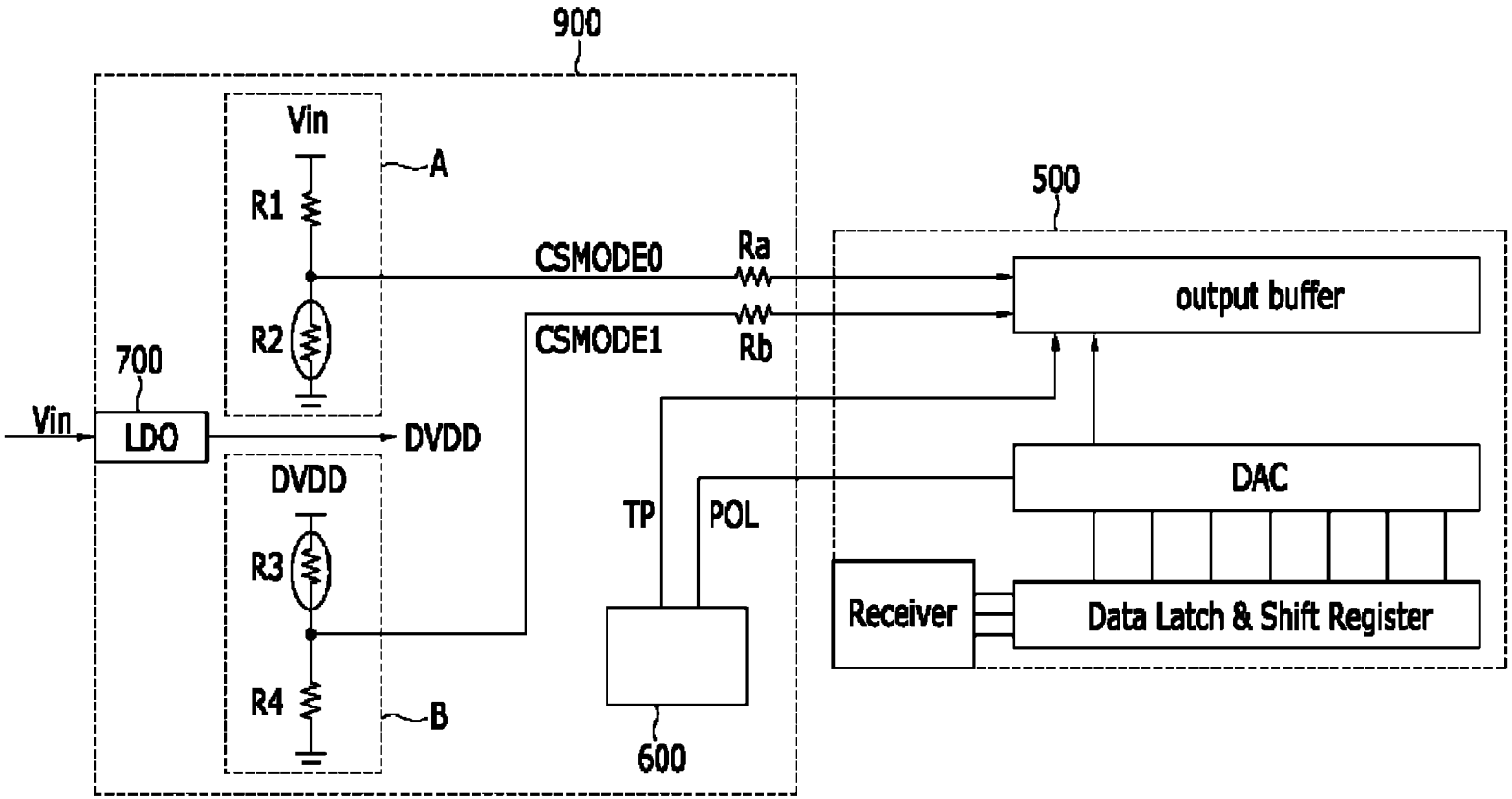
FIG. 7 is a schematic diagram illustrating a liquid crystal display according to an exemplary embodiment of the present invention.
Figure 8:
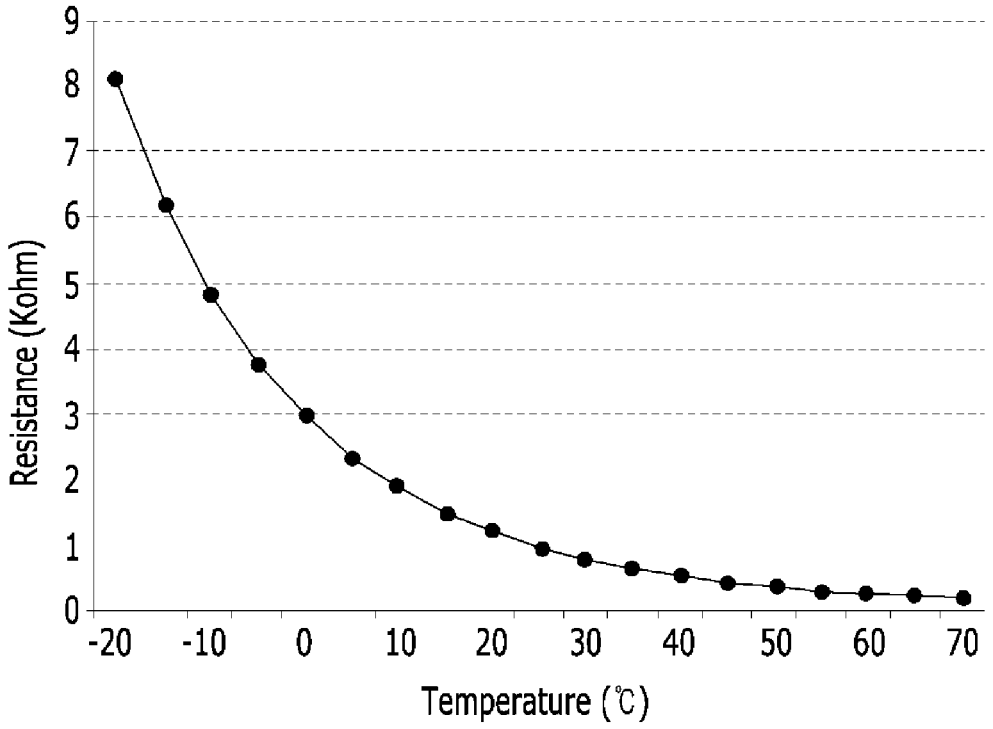
FIG. 8 is a graph illustrating a relationship between a temperature and a resistance of a negative temperature coefficient (NTC) resistor.
Figure 9:
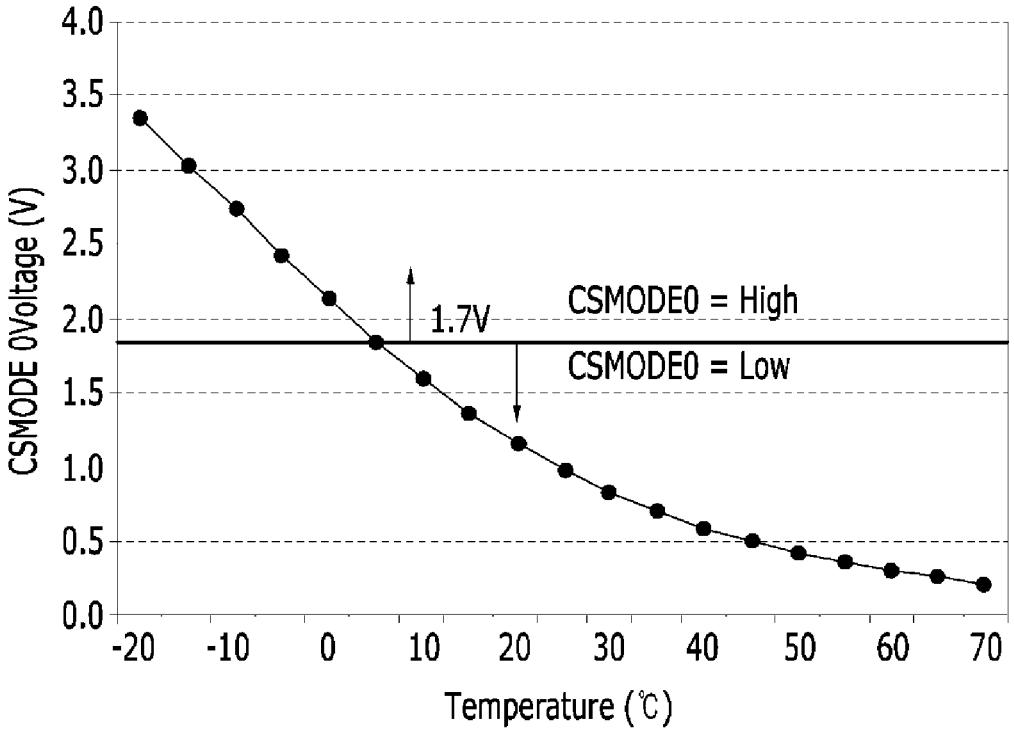
FIG. 9 is a graph illustrating a relationship between output voltage and a temperature for charge sharing unit A of FIG. 7.
Figure 10:
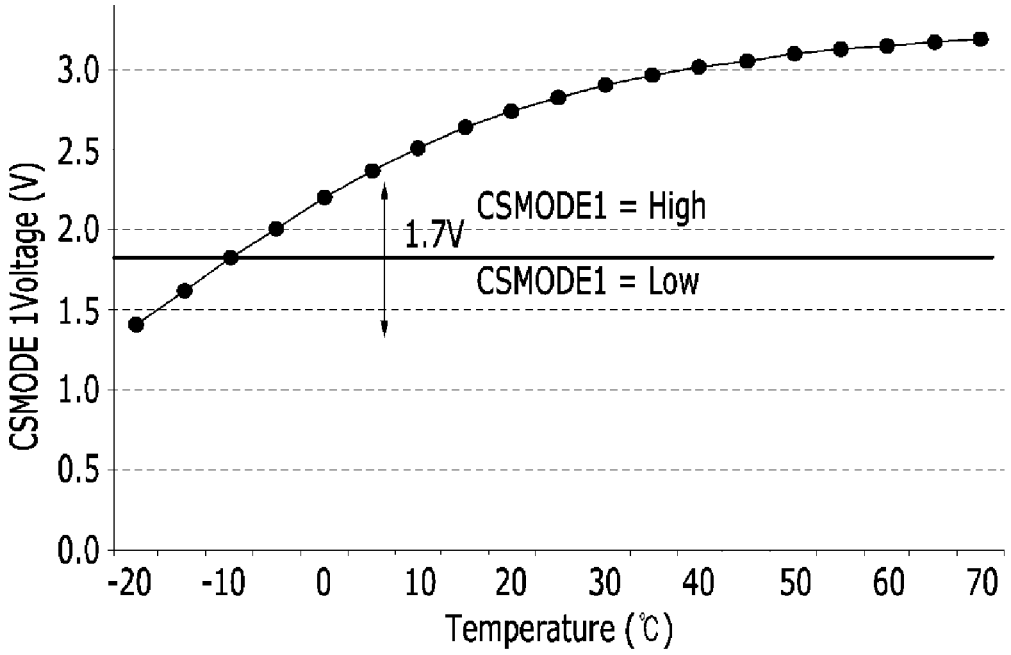
FIG. 10 is a graph illustrating a relationship between output voltage and a temperature for charge sharing unit B of FIG. 7.
Figure 11:
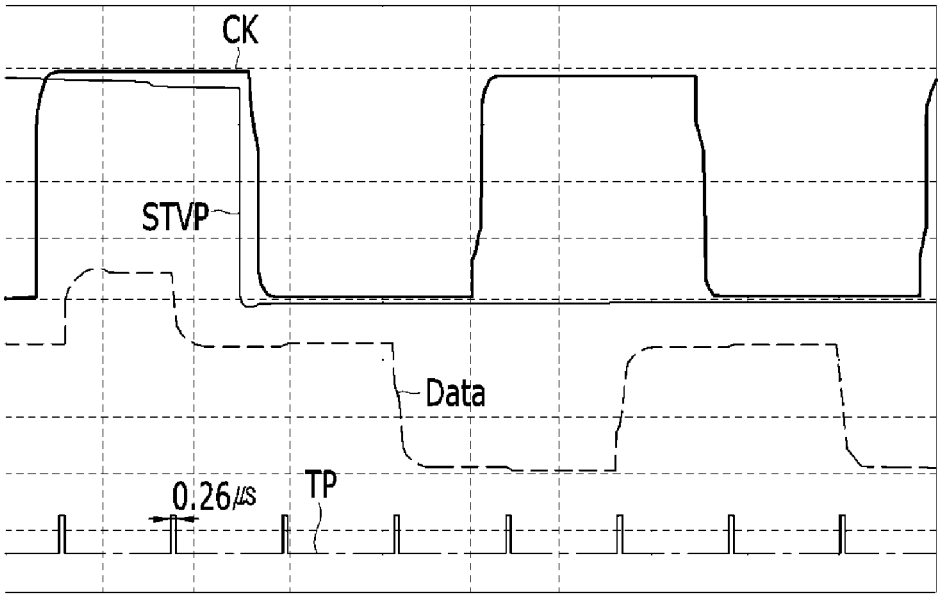
FIG. 11 is a signal waveform diagram of a liquid crystal display at room temperature according to an exemplary embodiment of the present invention.
Figure 12:
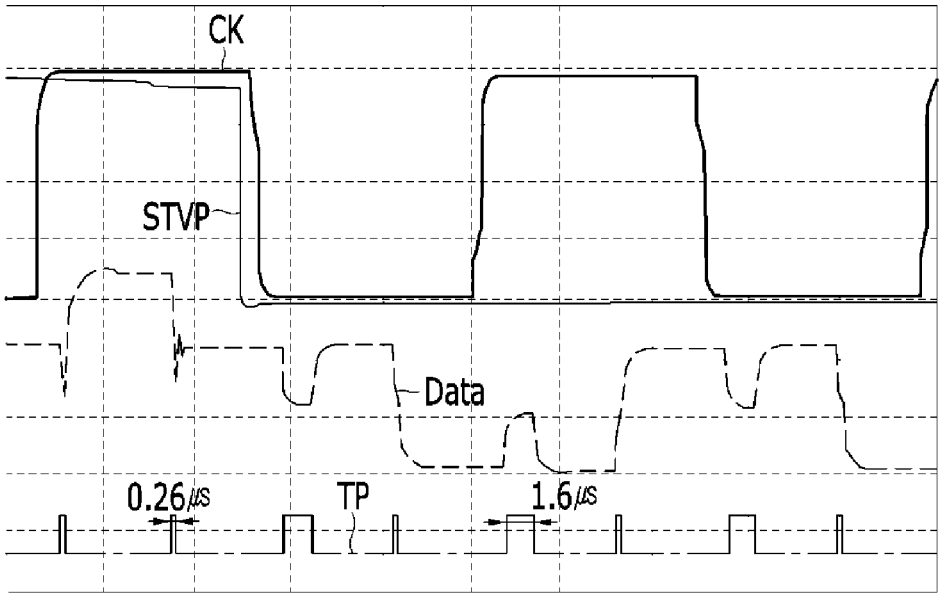
FIG. 12 is a signal waveform diagram of a liquid crystal display at a low temperature according to an exemplary embodiment of the present invention.

FIG. 7 is a schematic diagram illustrating a liquid crystal display according to an exemplary embodiment of the present invention, FIG. 8 is a graph illustrating a relationship between a temperature and a resistance of a negative temperature coefficient (NTC) resistor, FIG. 9 is a graph illustrating a relationship between output voltage and a temperature of charge sharing unit A of FIG. 7, FIG. 10 is a graph illustrating a relationship between output voltage and a temperature of charge sharing unit B of FIG. 7, FIG. 11 is a signal waveform diagram of a liquid crystal display at room temperature according to an exemplary embodiment of the present invention, and FIG. 12 is a signal waveform diagram of a liquid crystal display at a low temperature according to an exemplary embodiment of the present invention.

As an example for selectively applying the charge sharing techniques of FIGS. 5 and 6 to the data driver 500 of the liquid crystal display according to a temperature, charge sharing units A and B shown in FIG. 7 may be implemented.

Referring to FIG. 7, a control panel board assembly (PBA) 900 includes charge sharing units A and B, a low drop output unit (LDO) 700, and a signal controller 600.

The low drop output unit receives input voltage Vin to output an output voltage DVDD lower than the input voltage. For example, the input voltage may be 5 V and the output voltage may be 3.3 V.

The signal controller 600 may transmit an inversion signal POL controlling inversion drive to a digital analog converter DAC and may transmit a horizontal synchronizing signal TP to an output buffer. The charge sharing technique may be applied only in a polarity inversion at room temperature on the basis of the inversion signal POL, and the charge sharing technique may be applied every 1 horizontal period (1 H) at a low temperature less than room temperature on the basis of the horizontal synchronizing signal.

The charge share control signal may be transmitted to the output buffer through resistors Ra and Rb. Ra and Rb may be omitted.

The data driver 500 may include an output buffer, a digital analog converter, a data latch, a shift register, and a receiver.

The charge sharing units A and B include a negative temperature coefficient resistor and charge share control signals CSMODE0 and CSMODE1, which are outputted by the negative temperature coefficient resistor, in which a resistance varies according to a temperature, may vary. For example, CSMODE0 is recognized as a high value and CSMODE1 is recognized as a low value at room temperature and in this case, the charge sharing technique of FIG. 5 is applied to the data driver 500 and the charge sharing may occur only in the polarity inversion of the data voltage. Alternatively, CSMODE0 is recognized as a low value and CSMODE1 is recognized as a high value at a low temperature less than room temperature and in this case, the charge sharing technique of FIG. 6 is applied to the data driver 500 and the charge sharing may occur every 1 horizontal period (1 H). If both CSMODE0 and the CSMODE1 are recognized as the high values or as the low values, the charge sharing may be disabled.

Referring to FIGS. 7 and 8, the charge sharing units A and B include a voltage divider circuit using the negative temperature coefficient resistor and, in the negative temperature coefficient resistor, as a temperature is lowered, the resistance increases.

Referring to FIG. 7, in the charge sharing unit A, a normal resistor R1 is connected to the input voltage Vin of the low drop output unit 700, a negative temperature coefficient resistor R2 is grounded, and a terminal outputting the charge share control signal CSMODE0 is connected between the normal resistor R1 and the negative temperature coefficient resistor R2. For example, the Vin may be 5 V, the R1 may be 4 KΩ and the R2 may be an NTC resistor of 1 KΩ having a resistance characteristic shown in FIG. 8. The operation of the charge sharing unit A will be described. For example, referring to FIG. 9, when the temperature is about 5° C., the R2 is about 2 KΩ and CSMODE0 voltage is about 1.7 V, and when the temperature is about −20° C., the R2 is about 8 KΩ and the CSMODE0 voltage is about 3.3 V. When the CSMODE0 voltage is more than 1.7 V, CSMODE0 is recognized as the high value and when the CSMODE0 voltage is 1.7 V or less, CSMODE0 is recognized as the low value. As a result, CSMODE0 is recognized as the high value at a low temperature lower than the room temperature and CSMODE0 is recognized as the low value at room temperature or above.

Referring to FIG. 7, in the charge sharing unit B, a negative temperature coefficient resistor R3 is connected to the output voltage DVDD of the low drop output unit 700, a normal resistor R4 is grounded, and a terminal outputting the charge share control signal CSMODE1 is connected between the negative temperature coefficient resistor R3 and the normal resistor R4. For example, the DVDD may be 3.3 V, the R3 may be an NTC resistor of 1 KΩ having a resistance characteristic shown in FIG. 8, and the R4 may be 5 KΩ. The operation of the charge sharing unit B will be described. For example, referring to FIG. 10, when the temperature is about −10° C., the R3 is about 5 KΩ and the CSMODE1 voltage is about 1.7 V, and when the temperature is about 70° C., the R3 is close to about 0 ohm and the CSMODE1 voltage is close to about 3.3 V. When the CSMODE1 voltage is more than 1.7 V, CSMODE1 is recognized as the high value and when the CSMODE0 voltage is 1.7 V or less, CSMODE1 is recognized as the low value. As a result, CSMODE1 is recognized as the high value at room temperature or above and CSMODE1 is recognized as the low value at a low temperature lower than the room temperature.

Referring to FIGS. 11 and 12, in the liquid crystal display having the pixel layout shown in FIG. 4 and performing the two dot inversion drive, signal waveforms of a scan start signal STVP, a clock signal CK, data voltage DATA, and a horizontal synchronizing signal TP were measured and the purplish phenomenon did not occur at a low temperature. A frequency is 75 Hz. As shown in FIG. 11, the charge sharing is performed only in the polarity inversion at room temperature. As shown in FIG. 12, the charge sharing is performed every 1 horizontal period (1 H) at a low temperature and the charged amount of the data voltage is reduced in the section in which the same polarity of the data voltage is maintained to be the same as the charged amount of the data voltage in the polarity inversion.

Figure 13:
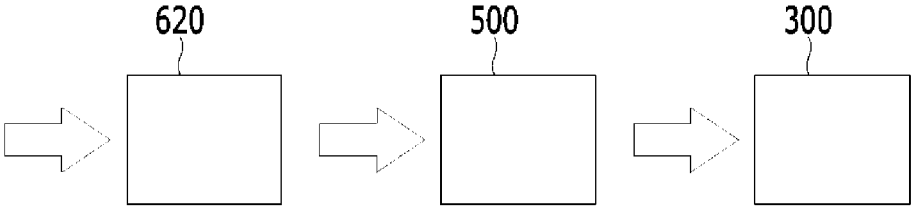
FIG. 13 is a schematic diagram illustrating a liquid crystal display according to an exemplary embodiment of the present invention.
Figure 14:
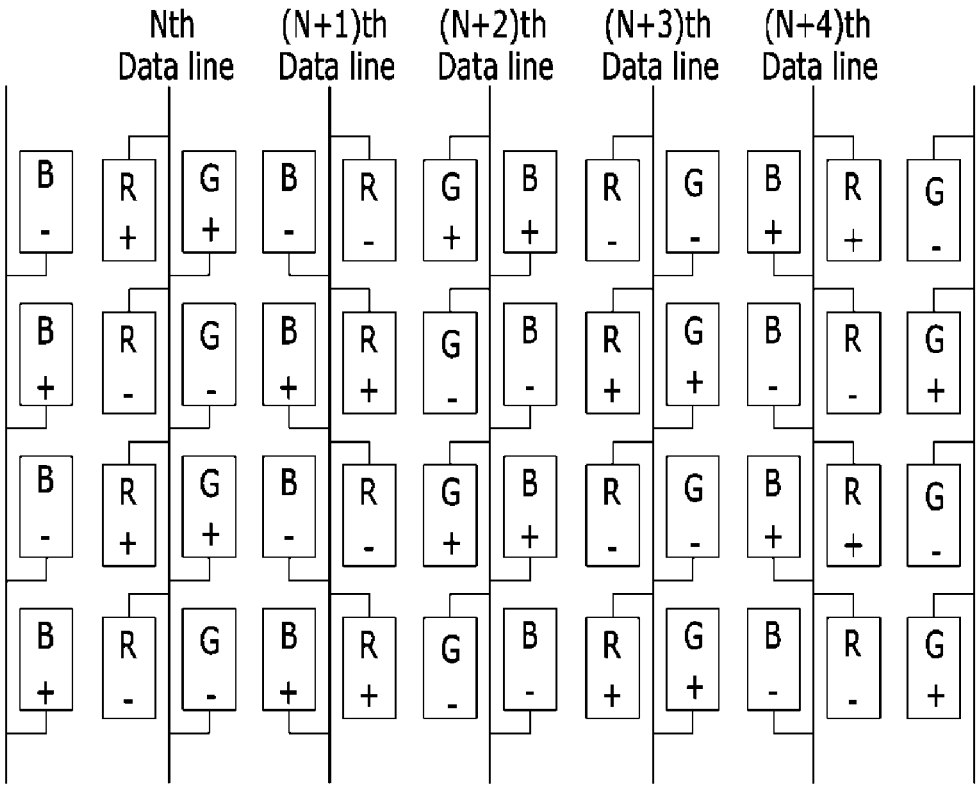
FIG. 14 is a waveform diagram of data voltage of a liquid crystal display according to an exemplary embodiment of the present invention.
Figure 15:
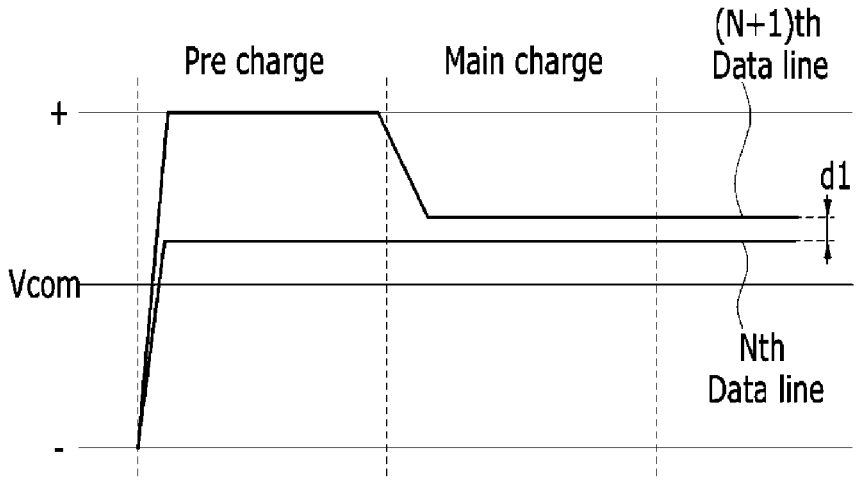
FIG. 15 is an exemplified diagram illustrating a liquid crystal display to which a mixed color pattern is inputted.
Figure 16:
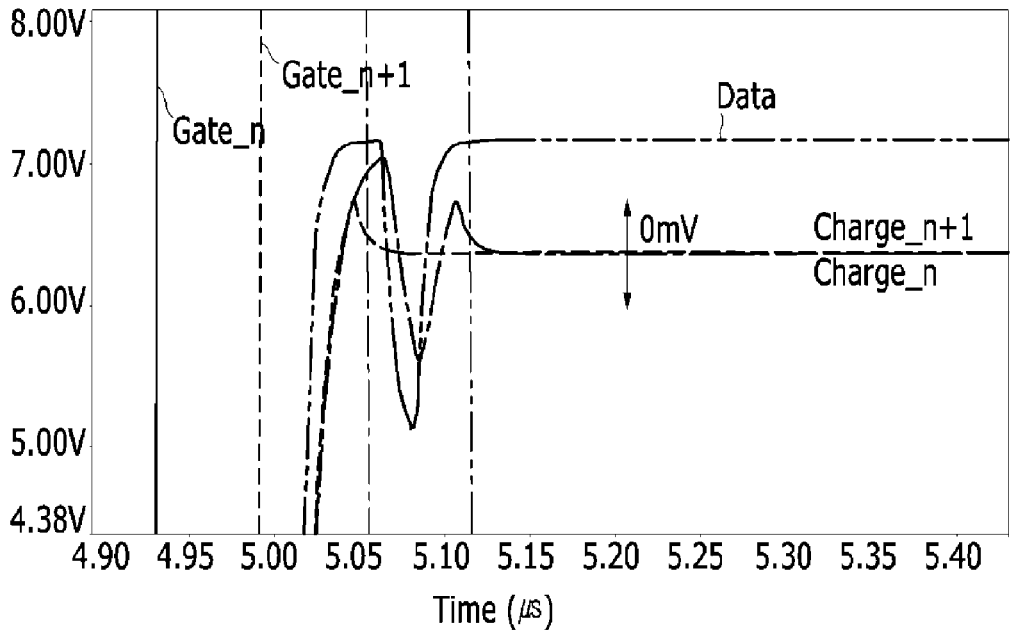
FIG. 16 is a waveform diagram of data voltage of a liquid crystal display when the charge sharing technique was applied.
Figure 17:
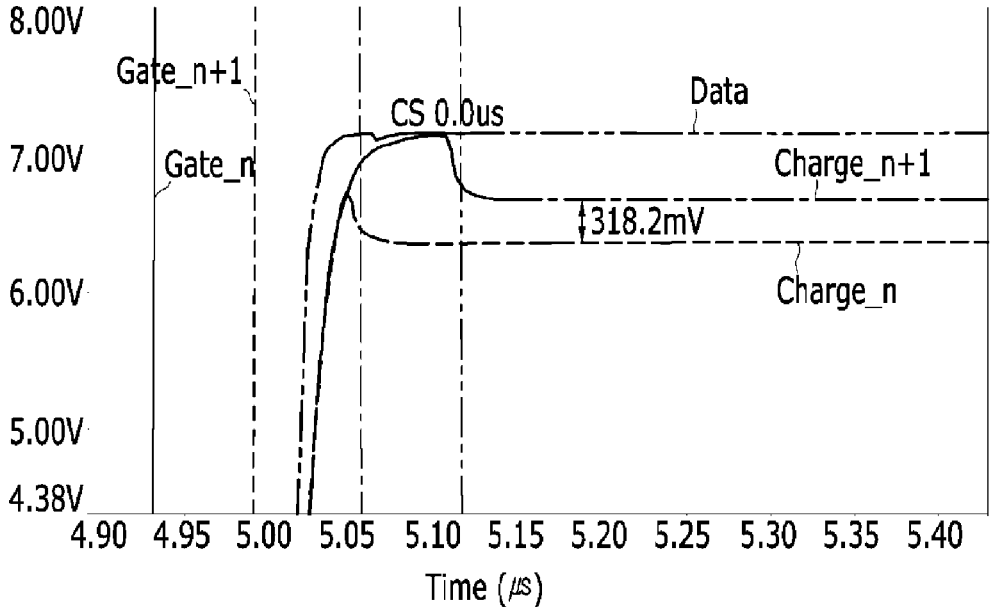
FIG. 17 is a waveform diagram of data voltage of a liquid crystal display when the charge sharing technique was not applied.

FIG. 13 is a schematic diagram illustrating a liquid crystal display according to an exemplary embodiment of the present invention, FIG. 14 is a waveform diagram of data voltage of a liquid crystal display according to an exemplary embodiment of the present invention, FIG. 15 is an exemplified diagram illustrating a liquid crystal display to which a mixed color pattern is inputted, FIG. 16 is a waveform diagram of data voltage of a liquid crystal display according to an exemplary embodiment of the present invention, and FIG. 17 is a waveform diagram of data voltage of a liquid crystal display according to an exemplary embodiment of the present invention.

The liquid crystal display recognizes a mixed color pattern by a pattern detection unit 620 and, when the mixed color pattern is recognized, the data driver 500 increases a charge sharing time and as a result, the charging time of the data voltage increases to prevent a bar line phenomenon.

For example, referring to FIG. 13, the pattern detection unit 620 detects a mixed color pattern in which data of the pixel is repeated in a constant pattern by using a memory buffer. The pattern detection unit 620 receives a low voltage differential signal, transmits a signal changing a pulse width of the horizontal synchronizing signal TP to the data driver 500 when the mixed color pattern is detected, and bypasses the horizontal synchronizing signal TP when the mixed color pattern is not detected. When the pattern detection unit 620 detects the mixed color pattern, the charge sharing technique may be applied every 1 horizontal period (1 H) and the charge sharing technique may be applied only in the polarity inversion. The data driver 500 applies the data voltage to the liquid crystal panel assembly 300 on the basis of the signal received from the pattern detection unit 620.

The mixed color pattern is a yellow pattern in the example shown in FIG. 14. In FIG. 14, R is red, G is green, and B is black. Referring to FIG. 14, all data are white in a precharge of the n-th data line and the n+3-th data line, but all the data are black in the precharge of the n+1-th data line, the n+2-th data line, and the n+4-th data line. Referring to FIG. 15, when a difference between the precharged data voltages is large in the adjacent data lines, if the charging time of the data voltage is insufficient, a charging deviation d1 may increase and the bar line phenomenon may occur. However, in the liquid crystal display of FIG. 13, even though the mixed color pattern as shown in FIG. 14 is inputted, the charging deviation d1 may decrease by increasing the charge sharing time, thereby preventing the bar line phenomenon.

Referring to FIGS. 16 and 17, in the liquid crystal display having the pixel layout shown in FIG. 4 and performing the two dot inversion drive, while the charge sharing time is changed, the charging deviation of the adjacent data lines was measured and the result is represented by the following Table 1.

TABLE 1

| | Charge sharing time (μsec) | | |
|---|---|---|---|
| | 0 | 1.0 | 2.0 |
| Charging deviation (mV) | 318.2 | 212.3 | 0 |

Referring to FIG. 17, when the charge sharing technique was not applied, a difference between the data voltages charged in the n-th data line and the n+1-th data line was 318.2 mV. Referring to FIG. 16, when the charge sharing technique was applied and the charge sharing time increased to 2.0 μsec, a difference between the data voltages charged in the n-th data line and the n+1-th data line was 0 mV.

According to exemplary embodiment of the present invention, it is possible to ensure a sufficient charging time at various temperatures, reduce the occurrence of a bar line, and improve display quality.

It will be apparent to those skilled in the art that various modifications and variations can be made in the present invention without departing from the spirit and scope of the invention. Thus, it is intended that the present invention cover the modifications and variations of this invention provided they come within the scope of the appended claims and their equivalents.

What is claimed is:

1. A liquid crystal display, comprising:

pixels;

a signal controller configured to receive an input image signal and an input control signal and to output a processing image signal and a control signal;

a data driver configured to change the processing image signal to data voltages based on the control signal; to supply the data voltages to the pixels; and to share charges of an odd channel data voltage and an even channel data voltage which have different polarities;

a first charge sharing unit configured to output a first charge share control signal; and a second charge sharing unit configured to output a second charge share control signal, wherein:

the input control signal comprises an inversion signal such that charge sharing occurs only when a polarity inversion of the odd channel data voltage or a polarity inversion of the even channel data voltage occurs at room temperature on the basis of the inversion signal and the first charge share control signal;

the input control signal comprises a horizontal synchronizing signal such that the charges are shared every 1 horizontal period (1 H) on the basis of the horizontal synchronizing signal and the second charge share control signal even if there is no inversion of the polarity of the odd channel data voltage or the polarity of the even channel data voltage, at a temperature less than the room temperature; and at room temperature, the first charge share control signal has a high value and the second charge share control signal has a low value and, at a temperature less than the room temperature, the first charge share control signal has the low value and the second charge share control signal has the high value.

2. The liquid crystal display of claim 1, wherein the pixels comprise a first pixel and a second pixel which are disposed to be horizontally adjacent to each other, a data line is disposed between the first pixel and the second pixel, and the data line is connected to the first pixel and the second pixel.

3. The liquid crystal display of claim 2, wherein the data driver is configured to drive the pixels using a two dot inversion drive scheme.

4. The liquid crystal display of claim 3, further comprising:

a pattern detection unit configured to recognize a mixed color pattern, wherein the data driver increases the charge sharing time in response to recognition of the mixed color pattern by the pattern detection unit.

5. The liquid crystal display of claim 1, wherein the first charge sharing unit comprises a first voltage divider circuit comprising a first normal resistor and a first negative temperature coefficient resistor, and the second charge sharing unit comprises a second voltage divider circuit comprising a second normal resistor and a second negative temperature coefficient resistor.

6. The liquid crystal display of claim 1, wherein the data driver comprises a first switch, a second switch, a first capacitor connected to the odd channel or the even channel through the first switch, a second capacitor connected to the odd channel or the even channel through the second switch, and a third switch switchably connecting the first capacitor and the second capacitor.

7. The liquid crystal display of claim 6, wherein, when the first capacitor and the second capacitor are connected to each other through the third switch, charges of data voltage charged in the first capacitor and data voltage charged in the second capacitor are shared.

8. The liquid crystal display of claim 1, wherein the pixels comprise a first pixel and a second pixel which are disposed to be horizontally adjacent to each other, a data line is disposed between the first pixel and the second pixel, and the data line is connected to the first pixel and the second pixel.

9. The liquid crystal display of claim 8, wherein the data driver is configured to drive the pixels using a two dot inversion drive scheme.

10. The liquid crystal display of claim 1, further comprising:

a pattern detection unit configured to recognize a mixed color pattern, wherein the data driver increases the charge sharing time in response to recognition of the mixed color pattern by the pattern detection unit.

11. A liquid crystal display, comprising:

pixels;

a signal controller configured to receive an input image signal and an input control signal and to output a processing image signal and a control signal;

a data driver configured to change the processing image signal to data voltages based on the control signal to supply the data voltages to the pixels and to share charges of an odd channel data voltage of an odd channel and an even channel data voltage of an even channel which have different polarities, the sharing of charges being based on temperature; and a first charge sharing unit and a second charge sharing unit, the first charge sharing unit comprising a first voltage divider circuit comprising a first normal resistor and a first negative temperature coefficient resistor and configured to output a first charge share control signal, and the second charge sharing unit comprising a second voltage divider circuit comprising a second normal resistor and a second negative temperature coefficient resistor and configured to output a second charge share control signal, wherein:

the first normal resistor is connected to an input voltage of a low drop output unit, the first negative temperature coefficient resistor is grounded, and the first charge share control signal is output from a node between the first normal resistor and the first negative temperature coefficient resistor; and the second negative temperature coefficient resistor is connected to an output voltage of the low drop output unit, the second normal resistor is grounded, and the second charge share control signal is output from a node between the second normal resistor and the second negative temperature coefficient resistor.

12. A method of sharing charges among data channels in a display panel, the method comprising:

determining a temperature;

sharing charges among data channels only during polarity inversion of a data voltage in response to the determined temperature being greater than a first value and a first charge share control signal, the data voltage being applied to display an image on the display panel; and sharing charges among data channels every one horizontal period (1 H) even if there is no change in the polarity of the data voltage, in response to the determined temperature being less than the first value and a second charge share control signal, wherein, at room temperature, the first charge share control signal has a high value and the second charge share control signal has a low value and, at a temperature less than the room temperature, the first charge share control signal has the low value and the second charge share control signal has the high value.

13. The liquid crystal display of claim 12, wherein the temperature is determined using a negative temperature coefficient resistor.

* * * * *